US005566596A

United States Patent [19]

Lin

[11] Patent Number: 5,566,596

[45] Date of Patent: Oct. 22, 1996

[54] HAND TOOL ASSEMBLY

[76] Inventor: Ching-Chou Lin, No. 150, Sec. 3, Chung Shan Rd., Wu Jih Hsiang, Taichung Hsien, Taiwan

[21] Appl. No.: 533,786

[22] Filed: Sep. 26, 1995

[51] Int. Cl.[6] ..... B25G 1/08

[52] U.S. Cl. ..... 81/490; 81/177.4

[58] Field of Search ..... 81/177.4, 490

[56] References Cited

U.S. PATENT DOCUMENTS 5,499,562 3/1996 Feng ..... 81/490 X

*Primary Examiner*—James G. Smith
*Attorney, Agent, or Firm*—Bacon & Thomas

[57] ABSTRACT

A hand tool assembly which includes a casing having a coupling portion at one end and a receptacle portion at an opposite end, a shank having a coupling rod at one end for fastening to the coupling portion of the casing and a socket at an opposite end for holding a tool bit for turning screws, and a cover detachably covered on the receptacle portion of the casing, the cover having two plug boards for fastening to the receptacle portion of the casing, and a plurality of tubular upright bit holders for keeping tool bits, the tubular upright bit holders defining a space for holding the socket of the shank for permitting the shank to be received inside the receptacle portion when the hand tool assembly is not in use.

5 Claims, 5 Drawing Sheets

HAND TOOL ASSEMBLY

BACKGROUND OF THE INVENTION

The present invention relates to hand tools, and relates more particularly to a hand tool assembly which can be arranged into the non-operative mode with the shank and bits received inside the casing, which is used as the handle of the tool.

FIG. 1 shows a hand tool assembly according to the prior art, which is generally comprised of a tool body and two fold-away boxes pivoted to the tool body at two opposite sides. The fold-away boxes define a plurality of chambers for holding a shank and a set of bits. The tool body has a polygonal coupling hole for mounting the shank. The shank has one end terminating in a socket for holding a bit. This structure of hand tool assembly is still not satisfactory in function. When the fold-away boxes are opened, the bits may fall out of the fold-away boxes as the tool body is shaken. Another drawback of this structure of hand tool assembly is that the fold-away boxes tend to be opened by an error when the hand tool assembly is operated. Furthermore, the tool body does not fit the hand, therefore it is not comfortable in use.

FIG. 2 shows another structure of hand tool assembly according to the prior art. This structure of hand tool assembly is comprised of a flat base, a shank, and a set of bits. The flat base comprises a longitudinal through hole for receiving the shank, and a plurality of chambers respectively separated by partition walls for holding the bits. This structure of hand tool assembly also has drawbacks. Because the chambers are open chambers, the bits tend to fall out of the chambers. Furthermore, because the flat base is not orthopedically engineered, it does not fit the hand well.

SUMMARY OF THE INVENTION

The present invention has been accomplished to provide a hand tool assembly which eliminates the aforesaid drawbacks. It is one object of the present invention to provide a hand tool assembly which can be conveniently arranged into the non-operative mode convenient for carry when it is not in use. It is another object of the present invention to provide a hand tool assembly which holds the accessories firmly and invisibly inside the casing thereof when it is arranged into the non-operative mode. It is still another object of the present invention to provide a hand tool assembly which has an orthopedically engineered casing for use as the handle of the tool.

According to the preferred embodiment of the present invention, the hand tool assembly comprises an orthopedically engineered casing, a shank, a cover, and a set of tool bits. The casing comprises a coupling portion at one end and a receptacle portion at an opposite end. The shank has a coupling rod at one end for fastening to the coupling portion of the casing, and a socket at an opposite end for holding a tool bit for turning screws. The cover is detachably covered on the receptacle portion of the casing, having two plug boards for fastening to the receptacle portion of the casing, and a plurality of tubular upright bit holders for keeping tool bits. The tubular upright bit holders define a space for holding the socket of the shank for permitting the shank to be received inside the receptacle portion when the hand tool assembly is not in use.

DETAILED DESCRIPTION OF THE PREFERRED EMBODIMENT

Figure 1:
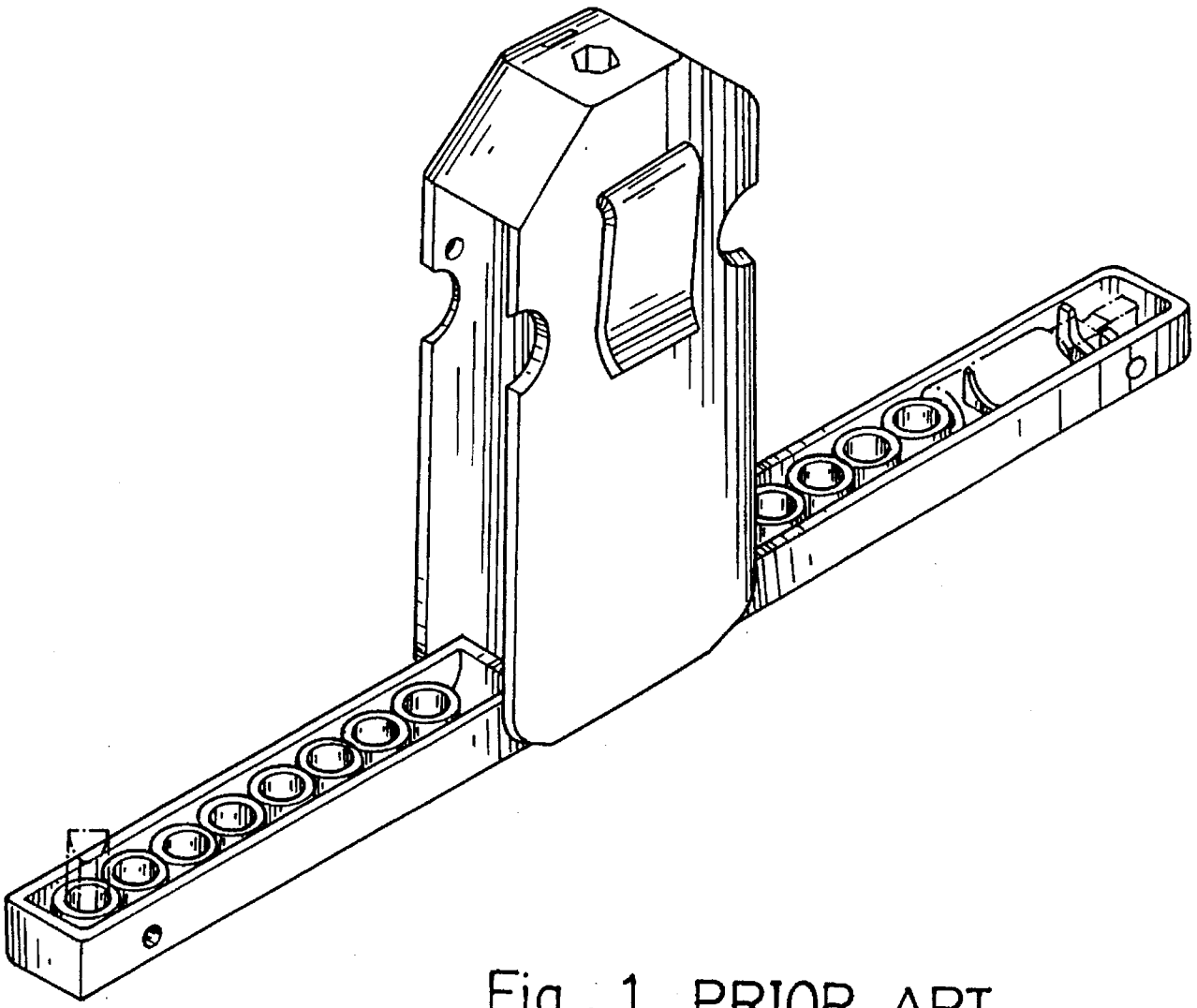
Fig. 1 PRIOR ART
FIG. 1 is an extended-out view of a hand tool assembly according to the prior art.
Figure 2:
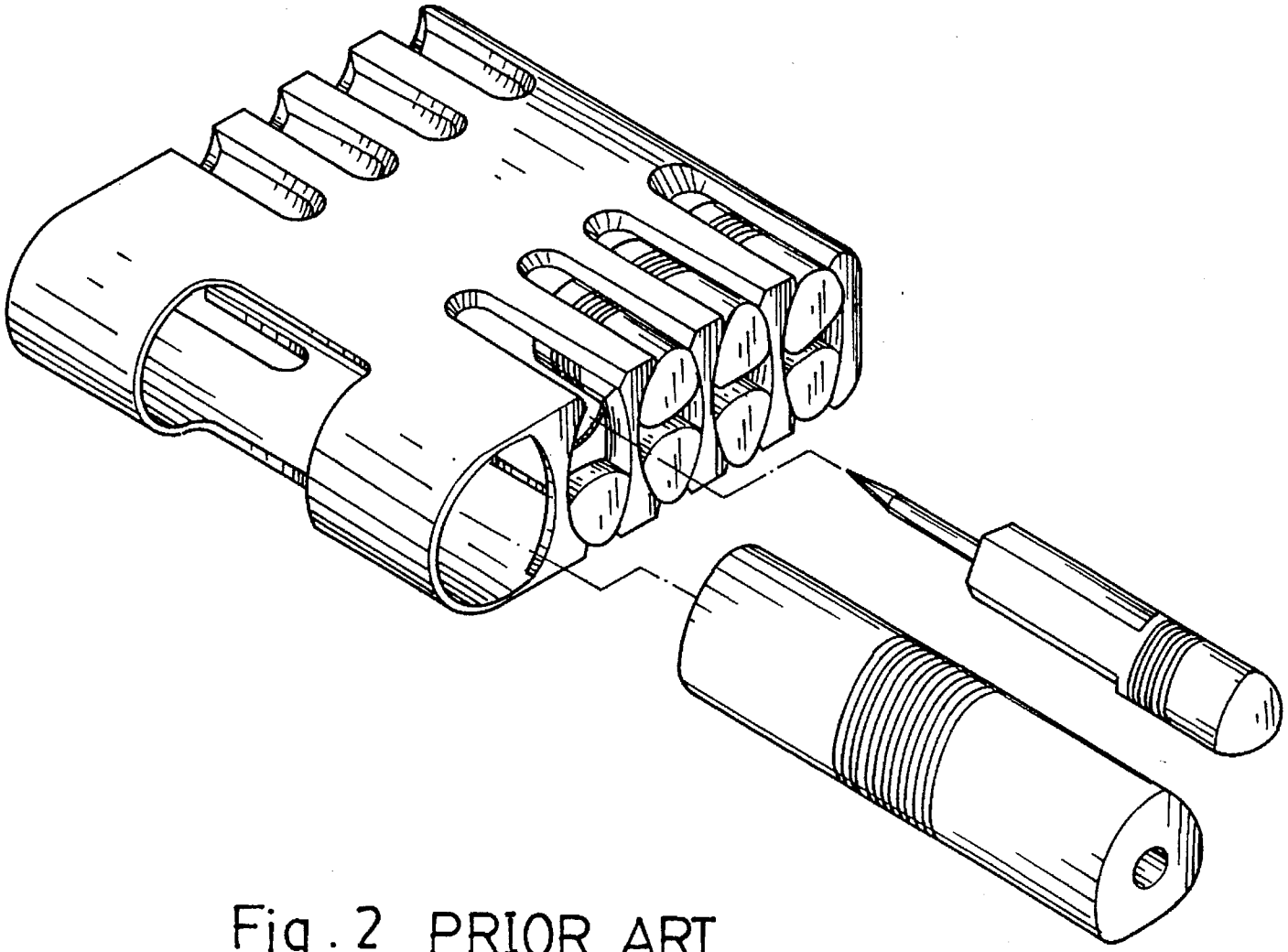
Fig. 2 PRIOR ART
FIG. 2 shows another structure of hand tool assembly according to the prior art.
Figure 3:
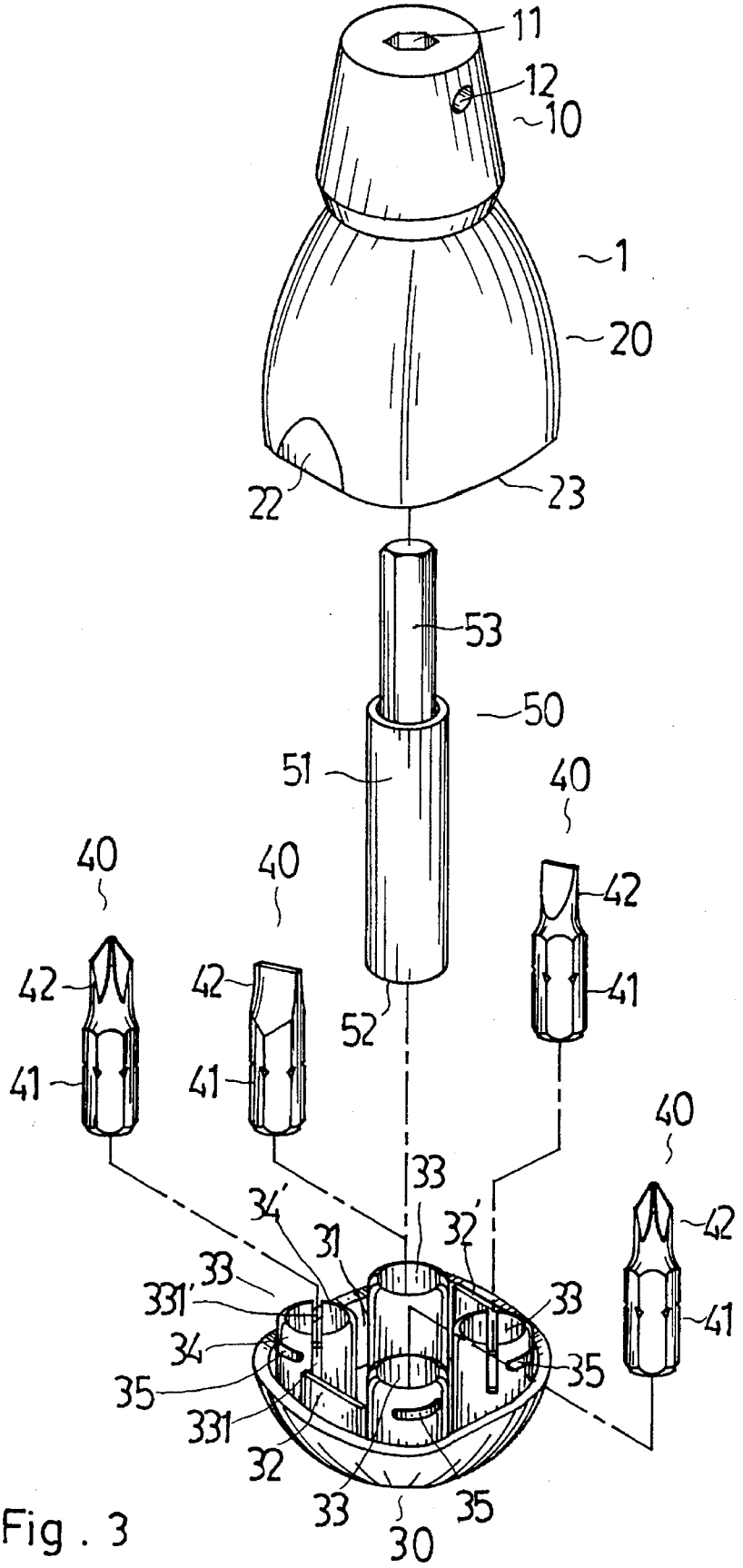
FIG. 3 is an exploded view of a hand tool assembly according to the present invention.
Figure 4:
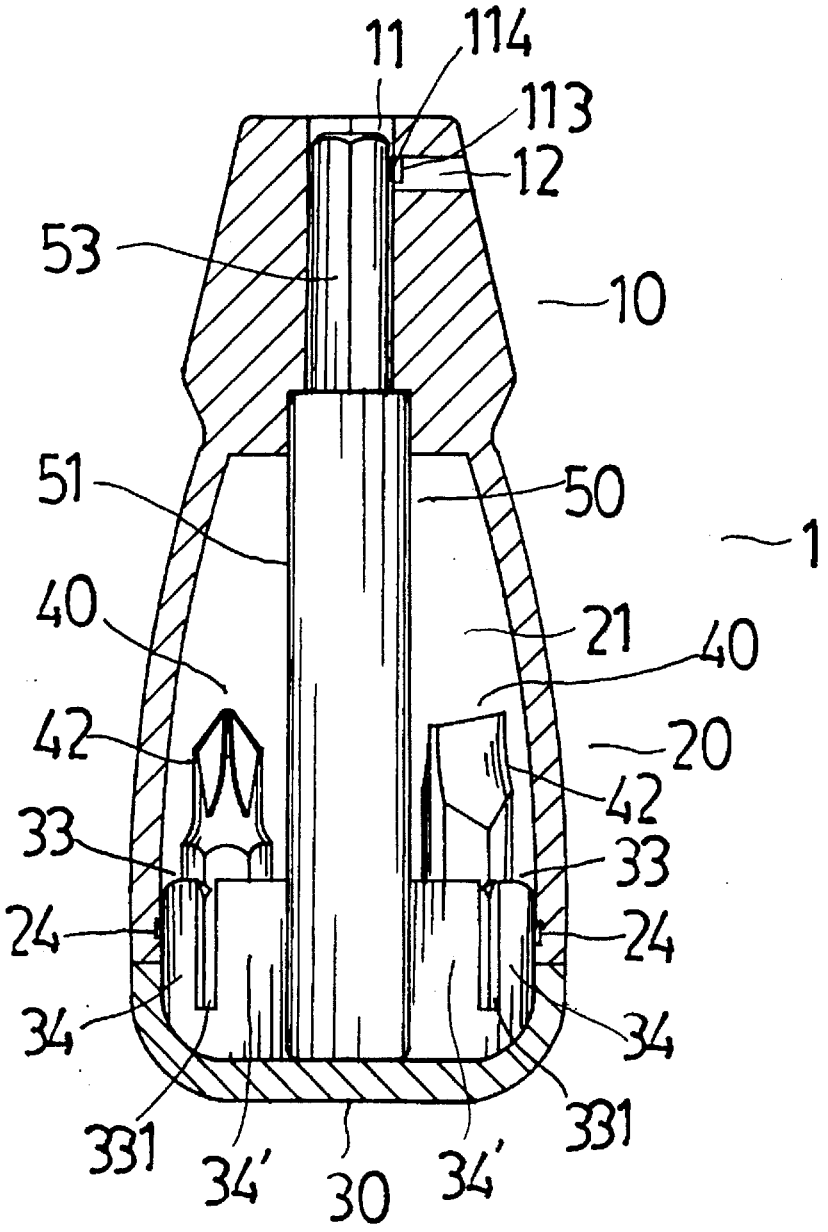
FIG. 4 is a sectional view showing the hand tool assembly of FIG. 3 arranged in the non-operative mode.

Referring to FIGS. 3 and 4, a hand tool assembly in accordance with the present invention is generally comprised of a casing 1, a cover 30, a shank 50, and a set of bits 40. The casing 1 comprises a coupling portion 10 at one end and a receptacle portion 20 at an opposite end. The receptacle portion 20 of the casing 1 defines a receiving space 21 and an orifice 23 at one end of the receiving space 21 remote from the coupling portion 10. Two sloping edges 22 are made on the outside wall of the receptacle portion 20 at two opposite locations near the orifice 23. An inside annular groove 24 is made around the inside wall of the receptacle portion 20 near the orifice 23. The coupling portion 10 comprises a polygonal center through hole 11 longitudinally disposed at the center, a radial side hole 12 perpendicularly connected to the polygonal center through hole 11, an inside projecting strip 113 suspending in the radial side hole 12 adjacent to the polygonal center through hole 11, and a raised portion 114 raised from the inside projecting strip 113 and projecting into the polygonal center through hole 11. The cover 30 covers on the orifice 23 of the receptacle portion 20 of the casing 1, comprising a recessed portion 31 on the inside, two upright plug boards 32 and 32' raised from the recessed portion 31 at two opposite sides corresponding to the sloping edges 22 of the receptacle portion 20 of the casing 1, and a plurality of upright bit holders 33 disposed inside the recessed portion 31 for holding the bits 40 respectively. When the cover 30 is covered on the orifice 23 of the receptacle portion 20 of the casing 1, the upright plug boards 32 and 32' of the cover 30 are forced into the orifice 23 and stopped against the peripheral wall of the receiving space 21 to retain the cover 30 to the receptacle portion 20 of the casing 1 firmly. Each of the bits 40 comprises a polygonal coupling rod 41 at one end and a working tip 42 at an opposite end. The upright bit holders 33 are made of tubular shape, each comprised of two symmetrical halves, namely, the outer half 34 and the inner half 34' separated by longitudinal splits 331 and 331'. When the polygonal coupling rod 41 of one bit 40 is inserted into one upright bit holder 33, the two symmetrical halves 34 and 34' are forced outwards for letting the polygonal coupling rod 41 be inserted into position. After the insertion of the polygonal coupling rod 41 into one upright bit holder 33, the bit 40 is firmly retained in place by the symmetrical halves 34 and 34' of the respective upright bit holder 33. The outer half 34 of each of the upright bit holders 33 has a tooth 35 on the outside. When the upright boards 32 and 32' of the cover 30 are forced into the orifice 23 of the receptacle portion 20 of the casing 1, the teeth 35 of the upright bit holders 33 are forced into engagement with the inside annular groove 24, and therefore the cover 30 is firmly retained to the is casing 1. The length of the shank 50 approximately equal to that of the casing 1. The shank 50 comprises a polygonal coupling rod 53 at one end and a socket 51 at an opposite end. When is the tool assembly is not in use, the shank 50 received inside the casing 1 by inserting the polygonal coupling rod 53 into the polygonal center through hole 11 of the coupling portion 10 of the casing 1 and inserting the socket 51 into the center of the recessed portion 31 of the cover 30 between the upright bit holders 33.

Figure 5:
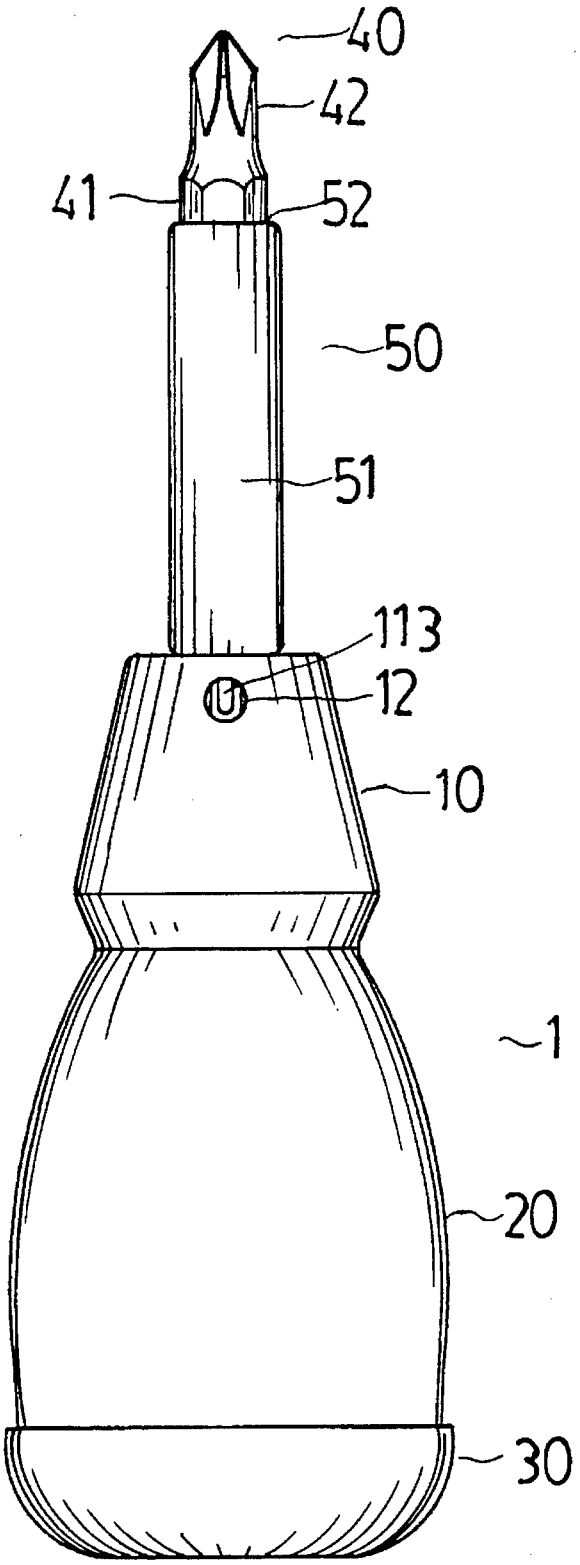
FIG. 5 shows the hand tool assembly of FIG. 3 arranged in the operative mode.

The cover 30 can be conveniently disconnected from the casing 1 by: gripping the sloping edges 22 of the receptacle portion 20 of the casing 1 with one hand, and pulling the cover 30 outwards from the casing 1 with the other hand. When the cover 30 is opened, the shank 50 is taken out of the cover 30 and attached to the casing 1 on the outside by inserting the polygonal coupling rod 53 into the polygonal center through hole 11 of the coupling portion 10 of the casing 1, and one bit 40 is removed from the respective upright bit holder 33 and attached to the polygonal hole 52 of the socket 51 of the shank 50 for turning screws. When the polygonal coupling rod 53 of the shank 50 is inserted into the polygonal center through hole 11 of the coupling portion 10 of the casing 1, the raised portion 114 of the inside projecting strip 113 is stopped against the polygonal coupling rod 53 of the shank 50 to hold it down. When the selected bit 40 is fastened to the shank 50 and the shank 50 is fastened to the casing 1 on the outside, the cover 30 is covered on the orifice 23 of the casing 1 again, and therefore the hand tool assembly is set into the operative mode for turning screws (see FIG. 5).

Because the bits 40 are firmly retained to the upright bit holders 33 by the respective symmetrical halves 34 and 34', they do not fall out of the upright bit holders 33 when the cover 30 is disconnected from the casing 1. When the hand tool assembly is arranged into the non-operative mode, the bits 40 and the shank 50 are received inside the casing 1 and covered by the cover 30 (see FIG. 4). Therefore, the hand tool assembly is convenient for carry when it is arranged into the non-operative mode. Furthermore, the cover 30 and the casing 1 are orthopedically engineered, and comfortable for holding by hand.

I claim:

1. A hand tool assembly comprising:

a casing, said casing comprising a coupling portion at one end, a receptacle portion at an opposite end, said coupling portion comprising a polygonal center through hole longitudinally disposed at the center, said receptacle portion comprising a receiving space in communication with the polygonal center through hole of said coupling portion, and an orifice at one end of said receiving space remote from said coupling portion;

a shank having one end terminating in a polygonal coupling rod for fitting into the polygonal center through hole of the coupling portion of said casing, and an opposite end terminating in a polygonal socket for holding a polygonal tool bit for turning screws; and a cover detachably covered on the orifice of the receptacle portion of said casing, said cover comprising a recessed portion on the inside, two upright plug boards raised from said recessed portion at two opposite sides and respectively inserted into the orifice of said receptacle portion and stopped against the periphery wall of said receiving space to hold said cover in place, and a plurality of tubular upright bit holders disposed inside said recessed portion for holding a respective tool bit, said tubular upright bit recessed holders defining a space within said recessed portion for holding the polygonal socket of said shank for permitting said shank to be received inside said casing, each tubular upright bit holder comprised of two symmetrical halves spaced by longitudinal splits for holding one tool bit, one half of each tubular upright bit having a tooth on the outside for engagement with an inside wall of the receptacle portion of said casing.

2. The hand tool assembly of claim 1 wherein the receptacle portion of said casing has two opposite sloping edges on the outside adjacent to said orifice for the holding of the hand for permitting said cover to be pulled away from said casing.

3. The hand tool assembly of claim 1 wherein the coupling portion of said casing comprises a radial side hole perpendicularly connected to said polygonal center through hole, an inside projecting strip suspending in said radial side hole adjacent to said polygonal center through hole, and a raised portion raised from said inside projecting strip and projecting into said polygonal center through hole for engaging the polygonal coupling rod of said shank upon the insertion of the polygonal rod of said shank into the polygonal center through hole of said coupling portion.

4. The hand tool assembly of claim 1 wherein each tubular upright bit holder is comprised of two symmetrical halves spaced by two longitudinal splits for holding one tool bit.

5. The hand tool assembly of claim 2 wherein the receptacle portion of said casing has an inside annular groove for engagement with the tooth of each tubular upright bit holder.

* * * * *